United States Patent [19]

McCarthy

[11] 4,030,597

[45] June 21, 1977

[54] COIN CONTAINER

[76] Inventor: Peter A. McCarthy, 106 Athens Ave., South Amboy, N.J. 08879

[22] Filed: Aug. 23, 1976

[21] Appl. No.: 716,820

[52] U.S. Cl. ..... 206/.83; 133/5 A; 133/6; 206/.84; 220/4 B

[51] Int. Cl.[2] ..... A45C 11/28

[58] Field of Search ..... 206/.8–.84, 206/72, 445; 220/306, 4 B, 4 E; 211/49 R, 49 D; 133/5 A, 6; 221/92

[56] References Cited

UNITED STATES PATENTS

| | | | |
|---|---|---|---|
| 504,026 | 8/1893 | Fiedler et al. | 133/5 A |
| 522,311 | 7/1894 | Armitage | 206/.82 |
| 667,104 | 1/1901 | Schlemmer | 206/.82 |
| 1,160,255 | 11/1975 | Buchrim | 133/6 |
| 2,245,066 | 6/1941 | Bouchard | 133/5 A |
| 2,895,488 | 7/1959 | Sederquist et al. | 133/6 |
| 3,317,073 | 5/1967 | Woerner | 220/4 B |
| 3,664,538 | 5/1972 | Fioretti | 220/4 E |

FOREIGN PATENTS OR APPLICATIONS

| | | | |
|---|---|---|---|
| 11,071 | 5/1898 | Sweden | 133/6 |

*Primary Examiner*—William Price
*Assistant Examiner*—Allan N. Shoap
*Attorney, Agent, or Firm*—Barry H. Freedman

[57] ABSTRACT

A reusable coin container serves as both a coin bank and a coin wrapper, and comprises two sections which snap together to form a pair of parallel cylinders each capable of holding a predetermined number of coins of a particular denomination. When the container is full, the sections are readily separated, and one section comprises a convenient holder from which coins may be dispensed. The container is arranged so that once full, insertion of an additional coin causes separation of the sections.

11 Claims, 10 Drawing Figures

COIN CONTAINER

BACKGROUND OF THE INVENTION

1. Field of the Invention

The present invention relates generally to reusable coin containers which are designed to hold, when full, a predetermined number of coins of a particular denomination.

2. Background of the Invention

Coin shortages have been experienced of late, due to the tendency of the public to accumulate coin rather than to return it to circulation via exchange at financial institutions for paper currency. One explanation for this tendency may be the inadequacy of presently available coin containers and wrappers in meeting the public's need for ease and convenience. For example, wrappers such as paper tubes are hard to fill, and do not always contain a predetermined number of coins; as a result, coins have to be counted, wasting time and labor and discouraging further exchange of coin for currency. Also, paper wrappers are easily broken or accidently opened, and are not reusable.

To avoid certain problems associated with paper coin wrappers, various plastic or metal coin holders or banks have been proposed. However, these containers still present problems with respect to ease of loading and unloading, compactness and portability. Various prior art designs were also quite complicated and thus costly, making commercial acceptance difficult.

In view of the foregoing, it is the broad object of the present invention to provide an improved coin container which is reusable, convenient and practical. Specific objects are the provision of a container which holds a predetermined number of coins of a particular denomination when full, and allows the user to determine the number of coins in the container when partially filled. Additionally, a still further object is to enable the use of a portion of the container itself as a coin dispensing tray, or enable its use in conjunction with conventional coin trays now found in financial institutions.

SUMMARY OF THE INVENTION

The foregoing and additional objects are achieved in accordance with the instant invention by a coin container which includes front and back sections which snap together to form two parallel cylinders each dimensioned to receive a predetermined number of coins of a particular denomination. The front section includes integral top and bottom plates formed transverse to the cylinders, at opposite ends thereof. The top plate is arranged to permit entry of coins into the cylinders; the bottom plate is arranged to preclude entry or exit of coins therefrom. When the sections are separated, the front section forms a convenient holder from which coins may be dispensed.

In accordance with the invention, the sections are held together by locking lugs formed on the top and bottom plates, the lugs being securable to flanged lips formed in the ends of the back section. To separate the sections, the top and bottom plates are simply bent to release the lugs from the lips; the container is reused by snapping the sections together after being emptied. Advantageously, the container is arranged so that insertion of an additional coin into the container once it is full causes the sections to separate by disengaging one lug from its associated lip.

BRIEF DESCRIPTION OF THE DRAWING

The foregoing features of the present invention, and the attendant advantages thereof, will be better appreciated by consideration of the following detailed description, when read in light of the accompanying drawing in which.

DETAILED DESCRIPTION

Figure 1:
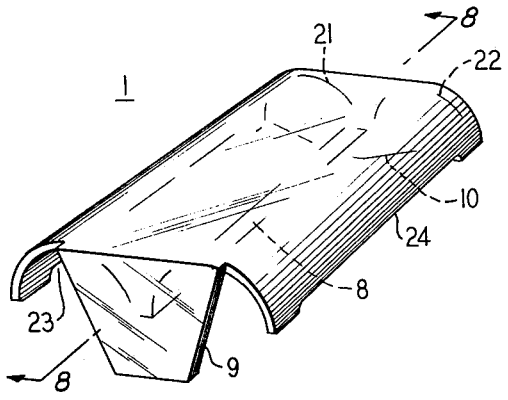
FIG. 1 is a perspective view of the front section of a coin container in accordance with the present invention.

Referring first to FIG. 1, the front section 1 of a coin container constructed in accordance with the present invention includes a unitary shell which defines two parallel semi-cylindrical channels 21, 22 formed along and separated by a common longitudinal wall 8. Section 1 may be molded or otherwise formed from a transparent plastic material. Integrally formed at one end, designated the top, of section 1 is a top plate 9, which is transverse to wall 8 and channels 21 and 22. Similarly, integrally formed at the other end, designated the bottom, of section 1 is a bottom plate 10, which is also transverse to wall 8 and channels 21 and 22.

Figure 2:
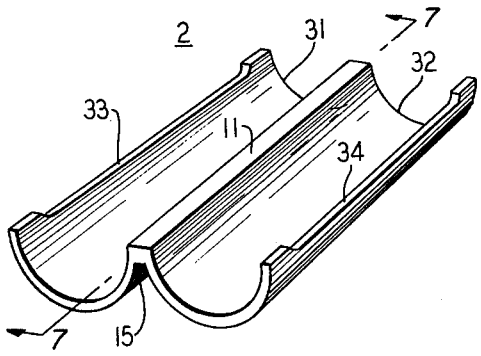
FIG. 2 is a perspective view of the back section of a coin container in accordance with the present invention.

As shown in FIG. 2, the back section 2 of a coin container constructed in accordance with the present invention includes a unitary shell which defines two parallel semi-cylindrical channels 31, 32 separated by and joined along a common longitudinal wall 11. Like front section 1, the back section 2 may be molded from a transparent plastic material; no top or bottom plates are formed in section 2. The diameter of channels 31 and 32 is equal to the diameter of channels 21 and 22.

Figure 3:
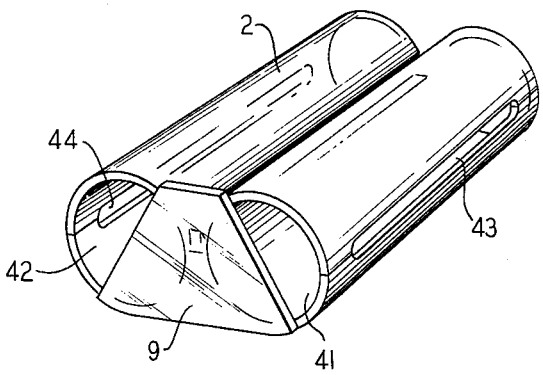
FIG. 3 is a back perspective view of an assembled coin container in accordance with the present invention, as seen from its top end.
Figure 4:
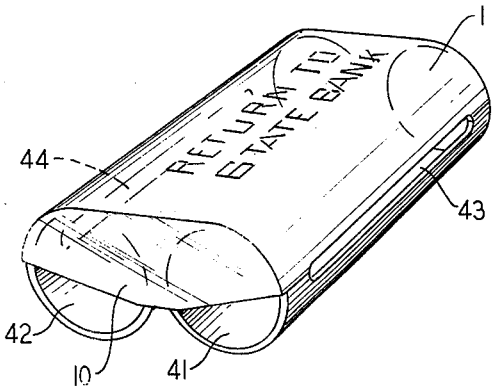
FIG. 4 is a front perspective view of the coin container of FIG. 3, as seen from its bottom end.

When front and back sections 1 and 2 are joined together, by means hereinafter described, the sections jointly define two parallel cylinders 41, 42 which are joined along and separated by common walls 8 and 11. By dimensioning channels 21, 22, 31 and 32 appropriately, cylinders 41 and 42 are each adapted to receive a predetermined number of coins of a particular size. For example, if the diameter of the channels is chosen as 0.750 to 0.755 inch and the length of the channels chosen as 2.930, inches then each cylinder 41, 42 will hold exactly 50 United States pennies, and the entire container will hold $1.00 worth of coin. Obviously, other dimensions will be used for other coin denominations. Perspective views of the coin container with sections 1 and 2 secured together are shown in FIGS. 3 and 4.

Figure 5:
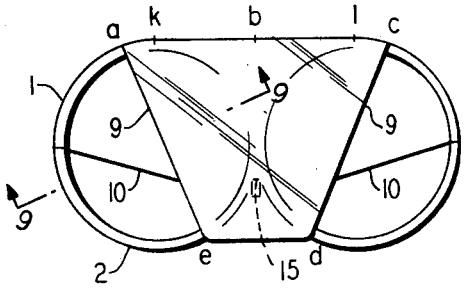
FIG. 5 is an end view of the container of FIG. 3 showing top plate 9.

Entry and exit of coins into and out of cylinders 41 and 42 is controlled by top and bottom plates 9 and 10. As shown in the end view of FIG. 5, the perimeter of top plate 9 roughly resembles a trapezoid. A first portion *a–b–c* of the perimeter corresponding to the base of the trapezoid) is co-extensive with a major portion of the outer perimeter of front section 1, as viewed from the top end. Second and third portions *a–e* and *c–d* of the perimeter (corresponding to the legs of the trapezoid) are straight lines which subtend minor arcs of cylinders 41 and 42, again as viewed from the top end. Finally, the fourth portion *d–e* of the perimeter (corresponding to the roof of the trapezoid) joins the straight line portions on a line that is outward from the common walls 8 and 11. Since top plate 9 is thus dimensioned so as to cover slightly less than half of the transverse area of cylinders 41 and 42, coin entry is thereby permitted.

Figure 6:
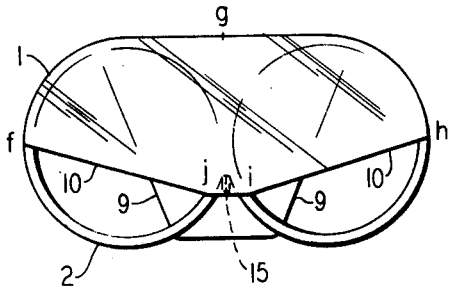
FIG. 6 is an end view of the container of FIG. 3 showing bottom plate 10.

As shown in the end view of FIG. 6, bottom plate 10 is somewhat larger in area than top plate 9. A first portion *f–g–h* of the perimeter of bottom plate 10 is co-extensive with essentially the entire outer perimeter of section 1, as viewed from the bottom end. Second and third portions *f–j* and *h–i* of the perimeter are straight lines which subtend major arcs of cylinders 41 and 42, again as viewed from the bottom end. Finally, the fourth portion *i–j* of the perimeter joins the straight line portions on a line that also is outward from the common walls 8 and 11. Since the bottom plate 10 is thus dimensioned so as to cover slightly more than half of the transverse area of cylinders 41 and 42, coin entry or exit from this end is thereby prevented.

Figure 7:
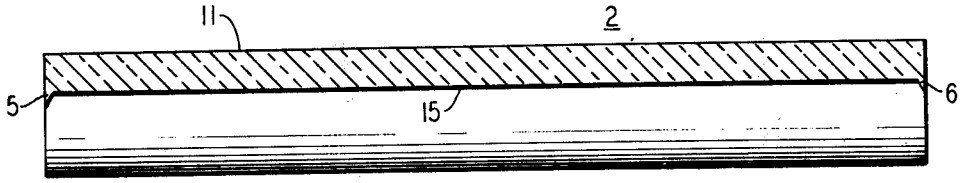
FIG. 7 is a cut-away view of the back section of FIG. 2, taken along its longitudinal center line.
Figure 8:
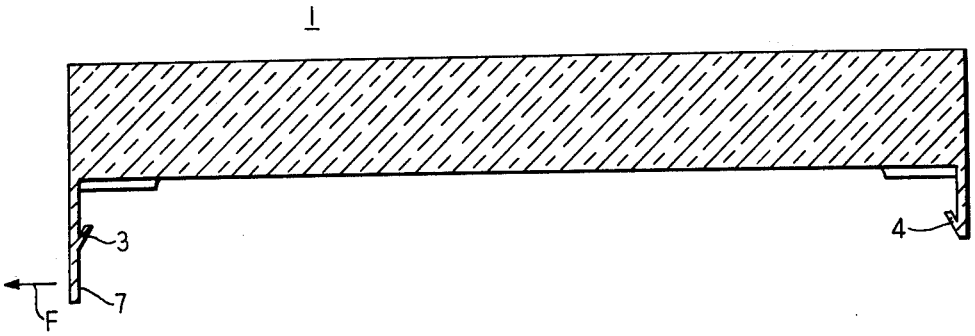
FIG. 8 is a cut-away view of the front section of FIG. 1 taken along its longitudinal center line.

To understand the manner in which front end back sections 1 and 2 are joined together, reference is now made to the cut-away views of FIGS. 7 and 8. In FIG. 7 this view is taken along the longitudinal center line of back section 2. As shown therein, the outer surfaces of channels 31 and 32 define a longitudinal groove 15 which corresponds to and is the outer surface of common longitudinal wall 11. Formed at the top and bottom ends of groove 15 are outwardly extending flanged lips 5 and 6, respectively. In FIG. 8, the cut-away view is taken along the longitudinal center line of front section 1. As shown therein, a first inwardly extending locking lug 3 is integrally formed in top plate 9 at its fourth perimeter portion, while a similar lug 4 is integrally formed in bottom plate 10 also at its fourth perimeter portion. Accordingly, it will be seen that when front and back sections 1 and 2 are properly aligned and pressed together, lug 3 will pass over and grasp lip 5, while lug 4 will pass over and grasp lip 6, thus securing the sections to each other. In this regard, it is preferable to allow a small amount of clearance or relief between walls 8 and 11, so that lugs 3 and 4 may readily extend past and then engage lips 5, 6 when the container is assembled.

Figure 9:
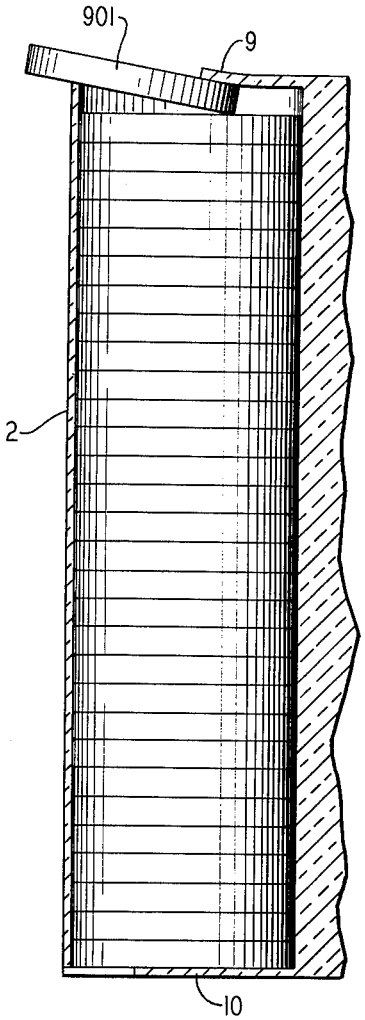
FIG. 9 is a cut-away view of one cylinder of the container of the present invention, taken along its longitudinal center line, with coins present in the cylinder, and an additional coin being inserted therein.

Once joined, if it is desired to separate sections 1 and 2, an outwardly extending arm 7 may be formed on top plate 9, as shown in FIG. 8; a bending moment in the direction of arrow F will then cause lug 3 to become disengaged from lip 5, after which lug 4 will of course become disengaged from lip 6. Alternatively, a user may simply apply outward pressure on either top plate 9 or bottom plate 10, again causing disengagement of one of the lugs from one of the corresponding lips. In accordance with a feature of the present invention, disengagement of the section 1, 2 may also be automatic upon an attempt by a user to insert an additional coin into the container when it is full. In this event, as shown in FIG. 9 the additional coin 901 inserted part way into either cylinder acts as a wedge to exert upward pressure on top plate 9. This pressure, as noted above, causes the lugs to disengage the lips and the sections to separate.

To avoid the problem of coins jamming or improperly seating within cylinders 41 and 42, it is advantageous to form narrow slits 23, 24 in a portion of the outer edge walls of cylinders 21 and 22, and similar slits 33, 34 in a portion of the outer edge walls of cylinders 31 and 32, as shown in FIGS. 1 and 2, respectively. These slits are complimentarily formed so that the container, when assembled as shown in FIGS. 3 and 4, includes first and second openings 43, 44 which communicate with the interiors of respective ones of cylinders 41 and 42, thereby facilitating straightening of coins improperly lodged therein.

Since a coin container in accordance with the invention is neat and compact, it is envisioned that it will be carried by a user in pocket or purse, and that coins will be inserted therein as they are accumulated. In order to apprise the user of the number of coins within the container, markings or graduations (not shown) may be inscribed or affixed to one or both cylinders, if the container is made from clear plastic. Otherwise, markings may be formed near openings 43 and 44. When the container is full, the user may be advised by a notation on the container to return it to his bank. At that time, the container may be emptied and the same container returned to the user for future use, or the full container may be exchanged for an empty container (and the currency equivalent of its contents). In order to provide a convenient place to inscribe or affix instructions or other advertising material, a portion of the outer surface of front section 1 may be flat. This flat portion *k–b–l* is shown best in the end view of FIG. 5 and is tangent to the remaining outer perimeter of channels 21 and 22. Typical advertising material is illustrated in the perspective view of FIG. 4.

When a full coin container is returned to a financial institution, the container is opened as described above. The coins are easily removed, since the entire contents of a cylinder may be grasped from the ends of the column of coins. Alternatively, the bank may simply leave the coins in section 1, which acts as a tray from which coins may be dispensed to other customers. Widespread acceptance, by banks, of the present coin container is envisioned, since significant amounts of labor are saved by not requiring manual coin counting, and the container provides an inexpensive means of encouraging exchange of coins for currency, thereby eliminating coin shortages. Additionally, the container provides a good vehicle for encouraging thrift and for advertising other bank services.

Figure 10:
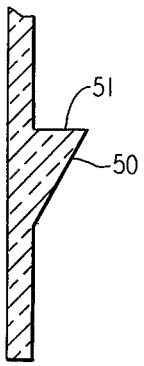
FIG. 10 is an enlarged view showing an alternate configuration for the locking lugs of FIG. 8.

Various adaptations and modifications of the present invention will be readily apparent to those skilled in the art. For this reason, it is intended that the invention be limited only by the scope of the appended claims. For example, locking lugs 3 and 4 of FIG. 8 can each be replaced by a lug 50 shown in the enlarged view of FIG. 10. The lug 50 includes a locking surface 51 which is perpendicular to the cover plate on which it is formed, rather than the hook or V shaped locking surface of lugs 3 or 4. In this event, outwardly extending flanged lips 5 and 6 need not be formed on the top and bottom ends of groove 15; instead, the lug 50 will directly grasp the outer ends of groove 15, which groove may be flat from end to end.

What is claimed is:

1. A reusable coin container comprising:

a. a front section comprising a unitary shell defining a first set of two parallel semi-cylindrical channels joined along a first common longitudinal wall;

b. a back section comprising a unitary shell defining a second set of two parallel semi-cylindrical channels of diameter substantially equal to said first set channels, said channels being joined along a second common longitudinal wall;

c. a top plate integrally formed on said front section transverse to said first set of channels at one end thereof;

d. a bottom plate integrally formed on said front section transverse to said first set of channels at the opposite end thereof; and e. means on said top and bottom plates for securing said front section to said back section whereby said sections jointly define two parallel cylinders separated by said first and second longitudinal walls; wherein f. said first and second sets of channels are dimensioned to define cylinders adapted to receive a predetermined number of coins of a predetermined size;

g. said top plate is dimensioned so as to permit entry of coins into said cylinders; and h. said plate bottom plate dimensioned so as to preclude entry and exit of coins into and out of said cylinders.

2. The container defined in claim 1 wherein:

said top plate is dimensioned so as to cover slightly less than half of the transverse area of said cylinders; and said bottom plate is dimensioned so as to cover slightly more than half of the transverse area of said cylinders.

3. The container defined in claim 2 wherein a first portion of the perimeter of said top plate is co-extensive with a major portion of the outer perimeter of said front section as viewed from said one end;

a second portion of said perimeter of said top plate includes straight lines subtending minor arcs of said cylinders, as viewed from said one end; and a third portion of said perimeter of said top plates joins said straight lines outwardly from said first common wall, as viewed from said one end.

4. The invention defined in claim 3 wherein a first portion of the perimeter of said bottom plate is co-extensive with a major portion of the outer perimeter of said front section, as viewed from said opposite end;

a second portion of said perimeter of said bottom plate includes straight lines subtending major arcs of said cylinders, as viewed from said opposite end; and a third portion of said bottom plate joins said straight line, outwardly from said first common wall, as viewed from said opposite end.

5. The invention defined in claim 4 wherein the outer surfaces of said second set of channels define a longitudinal groove along the outer surface of said second common longitudinal wall;

outwardly extending flanged lips are formed at the top and bottom ends of said groove; and said securing means include locking lugs integrally formed in said third portions of said perimeters of said top and bottom plates, said lugs being adapted for engagement with said flanged lips.

6. The invention defined in claim 5, wherein said front and back sections include narrow slits formed in a portion of the outer edges of said channels, said slits being complementarily formed so that said container, when assembled, includes first and second openings communicating with the interiors of respective ones of said two cylinders, thereby facilitating straightening of coins improperly lodged therein.

7. The invention defined in claim 6 wherein a portion of said outer perimeter of said front section is flat, said flat portion being tangent to the remaining outer perimeter of said first set of channels, as viewed from said one end.

8. The invention defined in claim 4 wherein the outer surfaces of said second set of channels define a flat longitudinal groove along the outer surface of said second common longitudinal wall, and said securing means include locking lugs integrally formed in said third portions of said perimeters of said top and bottom plates, said lugs adapted for engagement with the outer ends of said groove.

9. A coin container comprising:

a. a first molded section forming a first pair of parallel semi-cylindrical channels;

b. a second molded section forming a second pair of parallel semi-cylindrical channels having a diameter substantially equal to said first pair of channels;

c. first means for securing said second section to said first section wherein said first and second pairs of channels jointly define a pair of parallel cylinders;

d. second means in said first section for allowing entry of coins into said cylinders from one end thereof; and e. third means in said first section for preventing entry and exit of coins into and out of said cylinders from the opposite end thereof;

wherein said securing means includes;

f. first and second flanged lips formed on said second section; and g. first and second locking lugs formed on said second and third means, respectively, for engaging said flanged lips.

10. The invention defined in claim 9 wherein:

h. said second means includes a top plate formed transversely to the longitudinal axis of said first section;

i. said third means includes a bottom plate formed transversely to the longitudinal axis of said first section;

j. said top plate covers slightly less than half the transverse area of said cylinders; and k. said bottom plate covers slightly more than half the transverse area of said cylinders.

11. The invention defined in claim 10 wherein said first and second cylinders are joined along a common longitudinal wall;

a portion of said top and bottom plates extends outwardly from said common wall; and said locking lugs are formed on said outwardly extending portions.

* * * * *